US008529368B2

(12) United States Patent
Rice et al.

(10) Patent No.: US 8,529,368 B2
(45) **Date of Patent: *Sep. 10, 2013**

(54) GOLF CLUB HEAD

(71) Applicant: Callaway Golf Company, Carlsbad, CA (US)

(72) Inventors: Bradley C. Rice, Carlsbad, CA (US); William C. Watson, Temecula, CA (US); Patrick Dawson, San Diego, CA (US); Irina Ivanova, San Diego, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/645,319

(22) Filed: Oct. 4, 2012

(65) Prior Publication Data

US 2013/0165253 A1 Jun. 27, 2013

Related U.S. Application Data

(63) Continuation of application No. 13/555,406, filed on Jul. 23, 2012.

(60) Provisional application No. 61/578,789, filed on Dec. 21, 2011.

(51) Int. Cl.
*A63B 53/04* (2006.01)

(52) U.S. Cl.
USPC ..... 473/329; 473/345

(58) Field of Classification Search
USPC ..... 473/324–350
See application file for complete search history.

(56) References Cited

U.S. PATENT DOCUMENTS

| | | | | | |
|---|---|---|---|---|---|
| 1,705,997 | A | * | 3/1929 | Quynn | 473/329 |
| 1,835,718 | A | * | 12/1931 | Morton | 473/328 |
| 1,854,548 | A | * | 4/1932 | Hunt | 473/329 |
| 3,061,310 | A | * | 10/1962 | Giza | 473/329 |
| 3,680,868 | A | * | 8/1972 | Jacob | 473/328 |
| 3,961,796 | A | * | 6/1976 | Thompson | 473/328 |
| 4,043,563 | A | * | 8/1977 | Churchward | 473/338 |
| 4,076,254 | A | * | 2/1978 | Nygren | 473/337 |
| 4,085,934 | A | * | 4/1978 | Churchward | 473/338 |
| 4,319,752 | A | * | 3/1982 | Thompson | 473/328 |
| 5,050,879 | A | * | 9/1991 | Sun et al. | 473/338 |
| 5,205,560 | A | * | 4/1993 | Hoshi et al. | 473/345 |
| 5,213,328 | A | * | 5/1993 | Long et al. | 473/346 |
| 5,437,456 | A | * | 8/1995 | Schmidt et al. | 473/291 |
| 5,472,203 | A | * | 12/1995 | Schmidt et al. | 473/350 |
| 5,492,327 | A | * | 2/1996 | Biafore, Jr. | 473/332 |

(Continued)

FOREIGN PATENT DOCUMENTS

| | | | |
|---|---|---|---|
| JP | 06190088 | A * | 7/1994 |
| JP | 2002320691 | A * | 11/2002 |

(Continued)

*Primary Examiner* — Alvin Hunter

(74) *Attorney, Agent, or Firm* — Rebecca Hanovice; Michael A. Catania; Sonia Lari

(57) ABSTRACT

A golf club providing improved golf ball launch conditions is disclosed herein. The golf club includes a face component and a sole comprising an elongated recess disposed proximate the face component. The elongated recess preferably is tube shaped, and preferably has an opening with a smaller width than an innermost surface of the elongated recess.

20 Claims, 11 Drawing Sheets

(56) References Cited

U.S. PATENT DOCUMENTS

| | | | | | |
|---|---|---|---|---|---|
| 5,603,668 | A * | 2/1997 | Antonious | 473/328 |
| 5,735,754 | A * | 4/1998 | Antonious | 473/328 |
| 5,851,160 | A * | 12/1998 | Rugge et al. | 473/349 |
| 6,086,485 | A * | 7/2000 | Hamada et al. | 473/329 |
| 6,123,627 | A * | 9/2000 | Antonious | 473/327 |
| 6,344,001 | B1 * | 2/2002 | Hamada et al. | 473/329 |
| D482,090 | S * | 11/2003 | Burrows | D21/752 |
| D482,420 | S * | 11/2003 | Burrows | D21/752 |
| D484,208 | S * | 12/2003 | Burrows | D21/752 |
| 6,773,359 | B1 * | 8/2004 | Lee | 473/327 |
| 6,811,496 | B2 * | 11/2004 | Wahl et al. | 473/334 |
| D501,036 | S * | 1/2005 | Burrows | D21/752 |
| 6,887,165 | B2 * | 5/2005 | Tsurumaki | 473/344 |
| 7,004,852 | B2 * | 2/2006 | Billings | 473/332 |
| 7,083,530 | B2 * | 8/2006 | Wahl et al. | 473/334 |
| 7,108,609 | B2 * | 9/2006 | Stites et al. | 473/256 |
| 7,258,629 | B2 * | 8/2007 | Chen | 473/342 |
| 7,294,064 | B2 * | 11/2007 | Tsurumaki et al. | 473/329 |
| 7,393,286 | B1 * | 7/2008 | Renegar | 473/328 |
| 7,396,293 | B2 * | 7/2008 | Soracco | 473/329 |
| 7,500,924 | B2 * | 3/2009 | Yokota | 473/332 |
| 7,530,901 | B2 * | 5/2009 | Imamoto et al. | 473/334 |
| 7,549,933 | B2 * | 6/2009 | Kumamoto | 473/329 |
| 7,572,193 | B2 * | 8/2009 | Yokota | 473/328 |
| 7,582,024 | B2 * | 9/2009 | Shear | 473/329 |
| 7,828,674 | B2 * | 11/2010 | Kubota | 473/335 |
| 7,857,711 | B2 * | 12/2010 | Shear | 473/329 |
| 7,867,105 | B2 * | 1/2011 | Moon | 473/314 |
| 7,988,565 | B2 * | 8/2011 | Abe | 473/328 |
| 8,016,694 | B2 * | 9/2011 | Llewellyn et al. | 473/334 |
| 8,235,841 | B2 * | 8/2012 | Stites et al. | 473/328 |
| 8,235,844 | B2 * | 8/2012 | Albertsen et al. | 473/345 |
| 8,241,143 | B2 * | 8/2012 | Albertsen et al. | 473/345 |
| 8,241,144 | B2 * | 8/2012 | Albertsen et al. | 473/345 |
| 2002/0183134 | A1 * | 12/2002 | Allen et al. | 473/329 |
| 2004/0121852 | A1 * | 6/2004 | Tsurumaki | 473/344 |
| 2004/0192463 | A1 * | 9/2004 | Tsurumaki et al. | 473/329 |
| 2007/0021234 | A1 * | 1/2007 | Tsurumaki et al. | 473/329 |
| 2007/0026961 | A1 * | 2/2007 | Hou | 473/329 |
| 2007/0117648 | A1 * | 5/2007 | Yokota | 473/328 |
| 2011/0218053 | A1 * | 9/2011 | Tang et al. | 473/349 |

FOREIGN PATENT DOCUMENTS

| | | | |
|---|---|---|---|
| JP | 2004174224 | A * | 6/2004 |
| JP | 2004313762 | A * | 11/2004 |
| JP | 2004351054 | A * | 12/2004 |
| JP | 2004351173 | A * | 12/2004 |
| JP | 2005118526 | A * | 5/2005 |
| JP | 2010252964 | A * | 11/2010 |
| JP | 2010279847 | A * | 12/2010 |
| JP | 2011010722 | A * | 1/2011 |

* cited by examiner

GOLF CLUB HEAD

CROSS REFERENCES TO RELATED APPLICATIONS

The present application is a continuation of U.S. patent application Ser. No. 13/555,406, filed on Jul. 23, 2012, which claims priority to U.S. Provisional Patent Application No. 61/578,789, filed on Dec. 21, 2011, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head having a flexible face designed to improve golf ball launch conditions. The flexibility of the face is enhanced through the inclusion of an elongated recess in the sole of the golf club head.

2. Description of the Related Art

Traditionally, wood-type and hybrid-type golf club heads are manufactured by welding a face plate or a formed or cast face cup to a body made of one or more pieces. The face causes a golf ball striking the face to launch away from the golf club head. Golf clubs that are currently available on the market, however, do not provide optimized flexibility for impact with golf balls without impacting other factors involved in hitting a golf ball.

For example, several golf clubs currently on the market include sole features proximate the face that are intended to improve golf ball launch conditions. These sole features are slots or grooves having parallel side walls, as shown in FIG. 1, or side walls that slope away from each other as they approach the ground plane, as shown in FIG. 2. In both of these examples, the width of the bottom, innermost part of the groove (x1) is less than or equal to the width of the top, outermost part of the groove (x2). These groove structures typically are selected for ease of manufacture, but they do not provide optimized ball launch conditions. Furthermore, these groove structures can interfere with a golfer's swing because the large discontinuity in their openings causes the back edge of the groove to catch the turf during downswing and at impact.

Another fundamental problem with these groove structures is the fact that the groove opening (x2) drives the design of the groove. If a larger inner surface (x1) is required to improve launch performance, then the groove opening (x2) must also increase, thus impacting the visual appearance of the sole and increasing the likelihood of unwanted turf interaction during play. Therefore, there is a need for a golf club construction that provides improved golf ball launch conditions without also creating unwanted turf interactions.

BRIEF SUMMARY OF THE INVENTION

The present invention is directed to golf club body features that optimize launch conditions of a golf ball impacted on the face of a golf club head while simultaneously reducing interference created by other factors, including turf interaction.

One aspect of the present invention is a golf club head comprising a face component, a body, and a sole plate, wherein the sole plate is affixed to the face component with a lap joint, and wherein the sole plate is bonded to the body. The lap joint may comprise a compliant adhesive or a compliant sealant, and the component, body, and sole plate may each be composed of a metal material, which can be 17-4 steel. The golf club head may be a fairway wood head or a hybrid head. The face component may be integrally formed with the body, or it may be welded to the body after formation. The face component may further comprise variable face thickness for hitting optimization. In one alternative embodiment, the face component may be a metal face cup, the body and sole plate may both be made of metal, and the sole plate may be affixed to the face cup with a compliant adhesive and attached to the body via welding.

Another aspect of the present invention is a golf club head comprising a face component composed of 17-4 steel, a body comprising a crown portion, a side portion, and a sole portion, the body composed of 17-4 steel, and a sole plate composed of 17-4 steel, the sole plate comprising a front ledge and a back ledge, wherein the front ledge is affixed to the face component with a bonded lap joint, wherein the back ledge is welded to the sole portion of the body, and wherein the front ledge overlaps the face component. The front ledge may be disposed on an interior surface of the face component. The golf club head may have a volume of 150 to 300 cubic centimeters, and it may be selected from the group consisting of a driver head, a fairway wood head, and a hybrid head.

Yet another aspect of the present invention is a golf club head comprising a face component and a sole comprising an elongated recess disposed proximate the face component, wherein the recess comprises an innermost surface and an opening, wherein the opening comprises a first width, wherein the innermost surface of the recess comprises a second width, and wherein the first width is less than the second width. In some embodiments, the recess may extend from a heel side of the golf club head to a toe side of the golf club head. In some embodiments, the recess may comprise two overlapping prongs, and the opening may comprise an axis that forms anon-ninety degree angle with a ground plane. In some alternative embodiments, the opening may comprise an axis that is approximately perpendicular to a ground plane. In other embodiments, the opening may comprise an axis that forms a non-ninety degree angle with a ground plane.

In some embodiments of this aspect of the present invention, the recess may be tube shaped. In other embodiments, the recess may comprises two side walls, wherein the innermost surface may be planar and may be parallel with a ground plane, and at least one of the side walls may have an axis that forms a non-ninety degree angle with the ground plane some further embodiments, both side walls may have axes that form non-ninety degree angles with the ground plane. In some embodiments, the golf club head may further comprise a cover, which may be affixed to the sole so that it partially covers the opening. In these embodiments, the sole may comprise a shallow recess sized to receive the cover such that the cover is flush with the sole when the cover is disposed within the shallow recess. The cover may be removably affixed to the sole, and in some embodiments the cover may be composed of a high density material.

In some embodiments of this aspect of the present invention, the golf club head may be selected from the group consisting of a driver head, a fairway wood head, and a hybrid head. In other embodiments, the golf club head may have a volume of no less than 50 cubic centimeters and no more than 250 cubic centimeters. In some embodiments, the face and the sole of the golf club head may be integrally cast from a metal alloy.

Another aspect of the present invention is a wood-type golf club head comprising a metal body comprising a crown, a face, a sole, a heel side, and a toe side, and a tube shaped recess disposed in the sole proximate the face, wherein the tube shaped recess extends from the heel side to the toe side, wherein the tube shaped recess comprises a curved inner surface and an opening, wherein the width of the opening is less than or equal to half of a width of the curved inner surface, and wherein the opening comprises an axis that is perpendicular to a ground plane. In some embodiments of this aspect of the present invention, the golf club head may further comprise a junction between the face and the sole, and the tube shaped recess may be disposed no more than 0.01 inch from the junction. In some further embodiments, the tube shaped recess may have a volume of no less than 0.150 cubic inch and no more than 0.400 cubic inch.

Yet another aspect of the present invention is a golf club head comprising a metal face component and a metal sole comprising a heel side, a toe side, and a tube shaped recess extending from the heel side to the toe side, wherein the recess comprises two overlapping prongs, an internal diameter, and an opening, wherein the recess is disposed no more than 0.500 inch from an inner surface of the face component, wherein the opening comprises a width and an axis that forms a non-ninety degree angle with a ground plane, wherein the with of the opening is less than the internal diameter of the recess, and wherein the golf club head has a volume of no less than 50 cubic centimeters and no more than 300 cubic centimeters. In some further embodiments of this aspect of the present invention, the recess may comprise a wall with a thickness of no less than 0.020 inch and no more than 0.075 inch.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
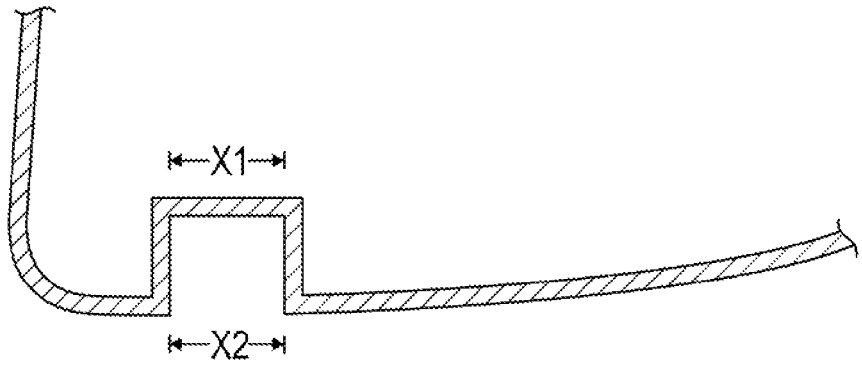
FIG. 1 (Prior Art)
FIG. 1 is a cross sectional view of a prior art golf club having a first sole groove configuration
Figure 2:
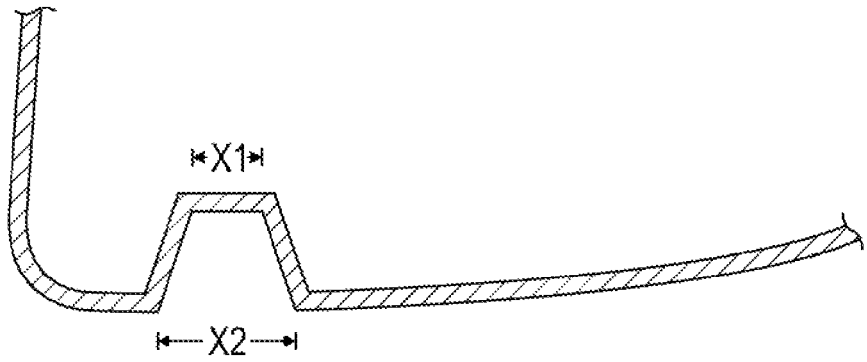
FIG. 2 (Prior Art)
FIG. 2 is a cross sectional view of a prior art golf club having a second sole groove configuration.
Figure 3:
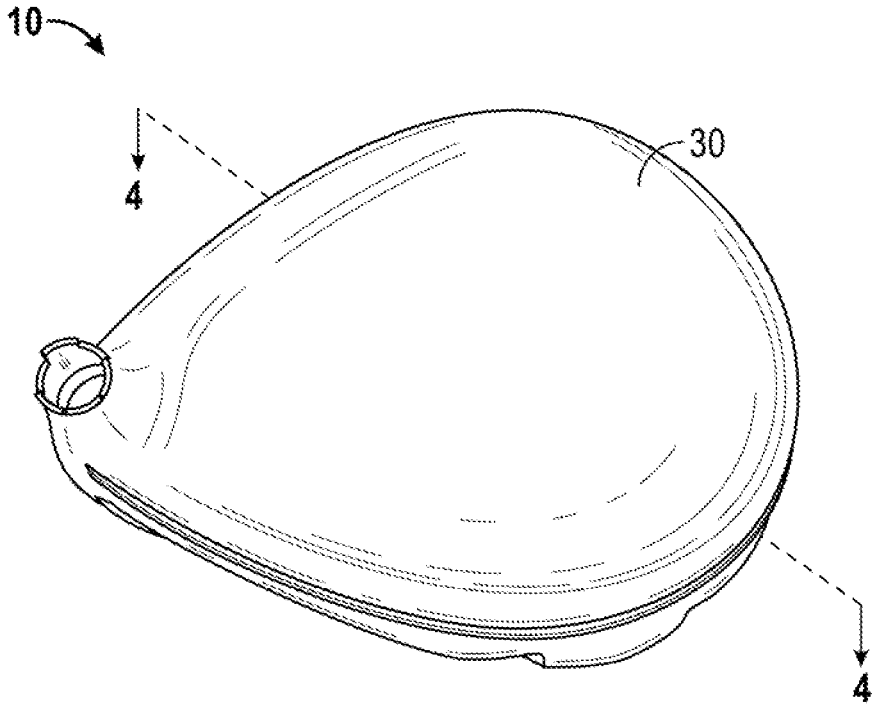
FIG. 3 is a top, perspective view of a first embodiment of the present invention.
Figure 4:
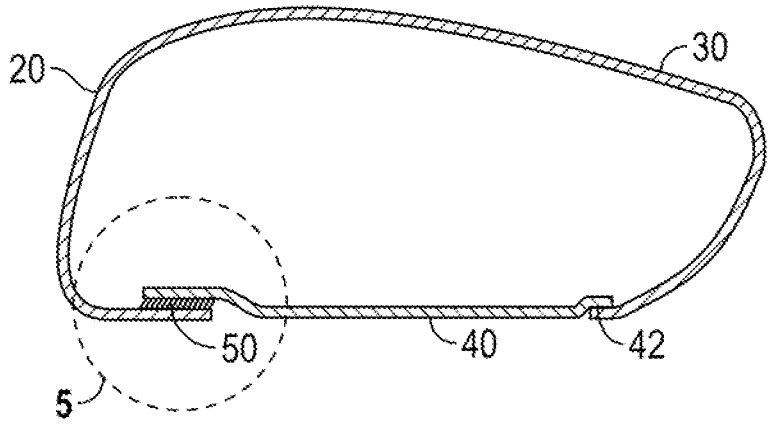
FIG. 4 is a cross-sectional view of the embodiment shown in FIG. 3 along lines 4-4.
Figure 5:
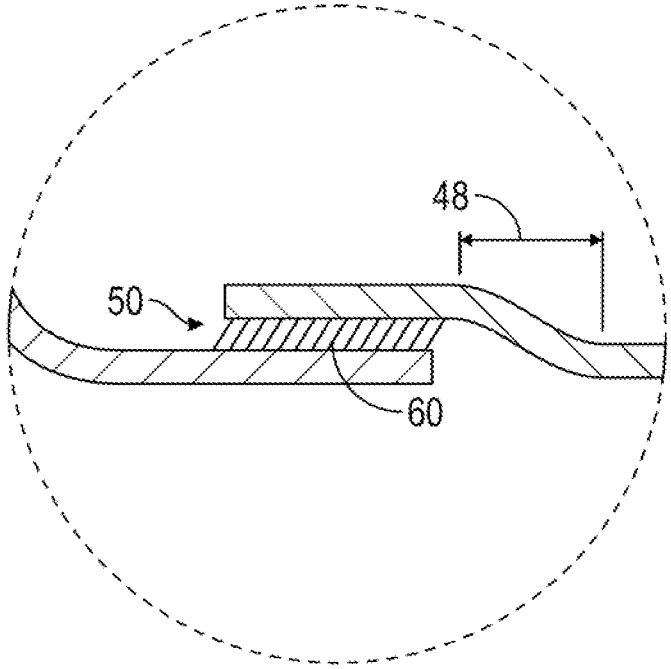
FIG. 5 is a close-up view of the region circled in FIG. 4.
Figure 6:
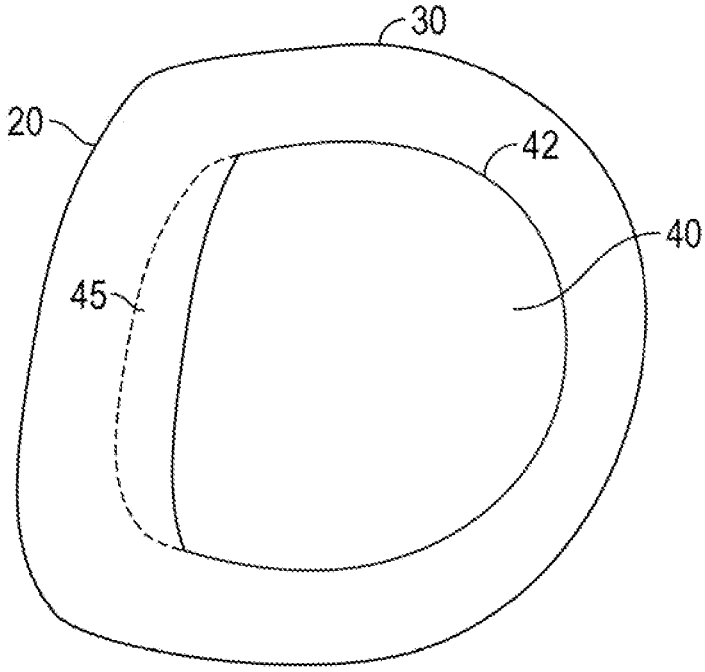
FIG. 6 is a sole, plan view of the embodiment shown in FIG. 3.
Figure 7:
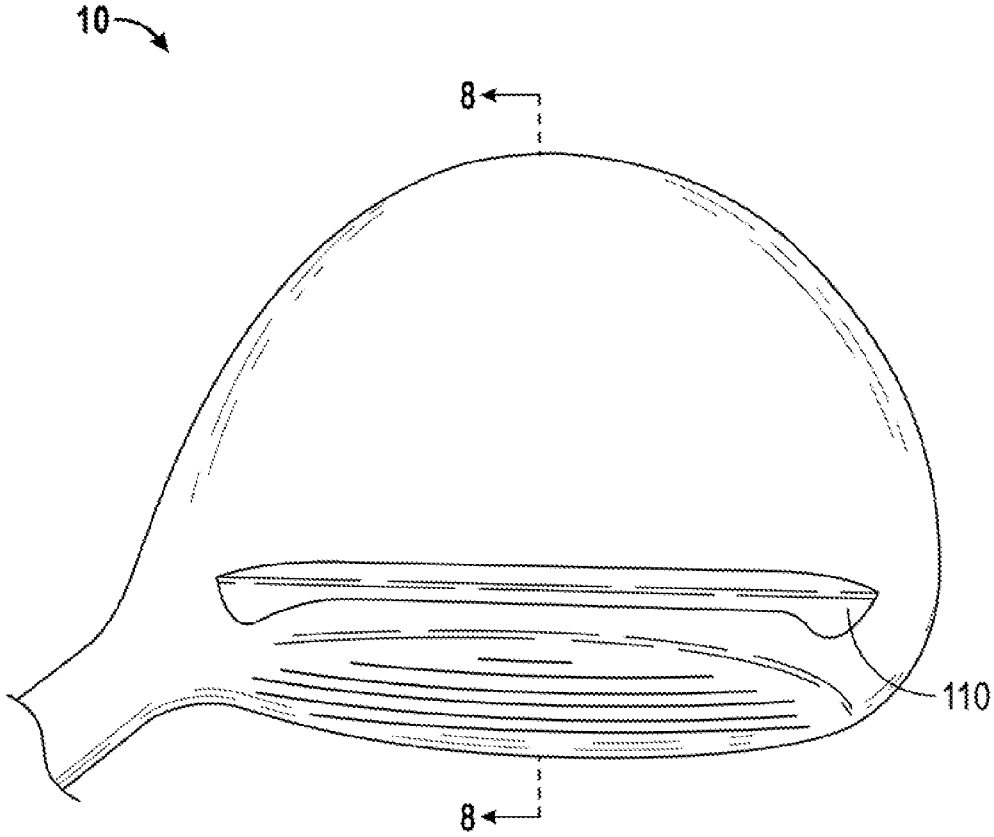
FIG. 7 is a sole, perspective view of a second embodiment of the present invention.
Figure 8:
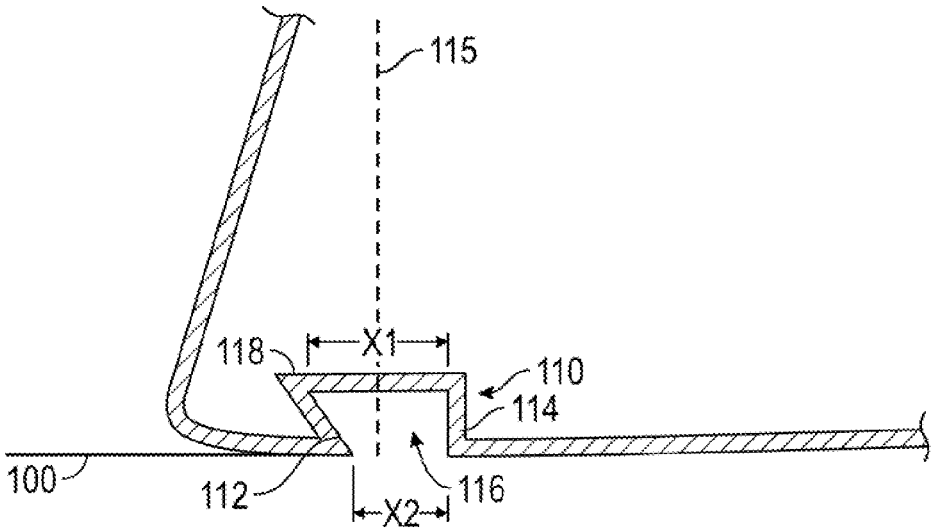
FIG. 8 is a cross-sectional view of the embodiment shown in FIG. 7 along lines 8-8.
Figure 9:
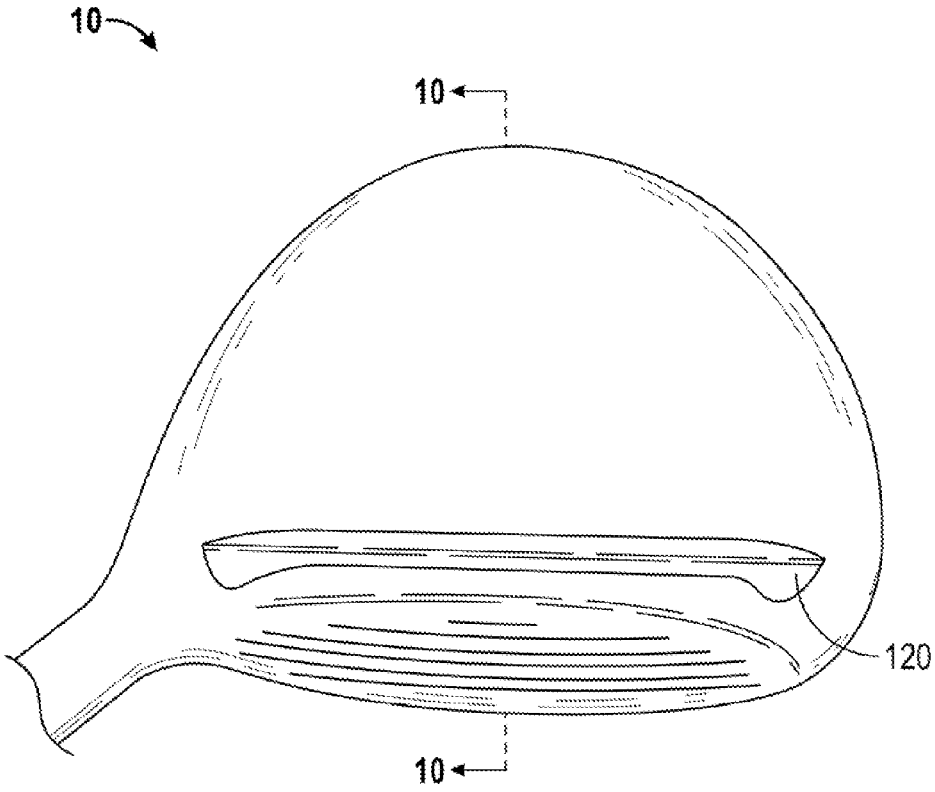
FIG. 9 is a sole, perspective view of a third embodiment of the present invention.
Figure 10:
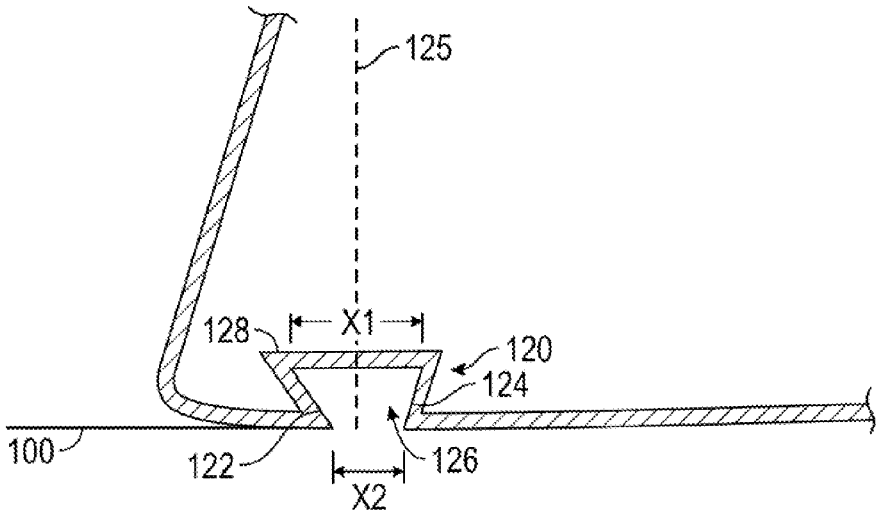
FIG. 10 is a cross-sectional view of the embodiment shown in FIG. 9 along lines 10-10.

The present invention is generally directed to a golf club head with an improved structure designed to reduce energy loss during impact of a golf club head with a golf ball, optimize and balance ball speed robustness, launch angle, and backspin, and reduce turf interaction by minimizing sole discontinuity.

Sole Lap Joint

A first embodiment of the present invention, shown in FIGS. 3-6, comprises a golf club head 10 with a face component 20, a body 30, and a sole plate 40 affixed to the face component with a bonded lap joint 50, which permits the golf club face 20 to flex in an optimized way upon impact with a golf ball. The back part of the sole plate 40 is preferably welded to the body 30 to form a seam 42, and the bonded lap joint 50 preferably comprises a compliant adhesive or sealant 60. The area of the sole plate 40 proximate the lap joint 50 preferably includes an overlap portion 45, which overlaps at least part of the face component 20, preferably on an inside surface of the face component 20. The sole plate 40 also preferably includes a reveal dimension 48 representing a visible recessed area proximate the overlap portion 45. The reveal dimension 48 preferably is small so as to avoid unwanted turf interaction during play.

The face component 20 of the golf club head 10 of the first embodiment preferably is integrally formed with the body 30 for the sake of efficiency during manufacturing, such that a hole is left in the sole of the head 10. This hole is then covered with the sole plate 40, which can be cast, formed, rolled or cut from a metal material. This configuration lowers the overall center of gravity (CG) of the club head 10, particularly if the sole plate 40 is formed of a high density material, prevents the CG from moving forward as far as it would if there were a slot or gap between the face 20 and the sole plate 40, and permits the use of cast 17-4 steel in construction of the head 10, which reduces the manufacturing cost of the head 10 when compared to the use of expensive metals like titanium alloy. The head 10 shown in the first embodiment also does not have an exposed cavity in its sole, which prevents the club head 10 from collecting debris or dirt during use.

Modified Groove

Other embodiments of the present invention are directed to grooves that optimize launch conditions without creating unwanted turf interactions. This is accomplished by de-coupling the groove's shape from its exit geometry size and shape, white at the same time allowing for ease of manufacture, visually appealing aesthetics, and increased performance metrics. As shown in each of the following embodiments, unwanted sole discontinuity, and the resulting turf interaction, is minimized by narrowing the surface opening of the groove. These grooves are also designed to increase the resulting ball speed of a golf ball struck by a head incorporating the grooves without negatively impacting other factors that affect striking distance, including launch angle and backspin.

For example, the sole grooves 110, 120 included in the second and third embodiments of the present invention, illustrated FIGS. 7-8 and 9-10 respectively, have trapezoidal configurations, each with an opening 116, 126 having an axis 115, 125 that is substantially perpendicular to the ground plane 100, and a width (x2) that is smaller than the width (x1) of the inner most surface 118, 128 of the groove 110, 120. The second embodiment has one negative draft wall 112 and another wall 114 that is approximately perpendicular to the ground plane 100, white the third embodiment has two negative draft walls 122, 124, creating a smaller opening than the one created by the structure of the second embodiment. These sole grooves 110, 120 can be created using casting undercutting methods that are well known in the art.

Figure 11:
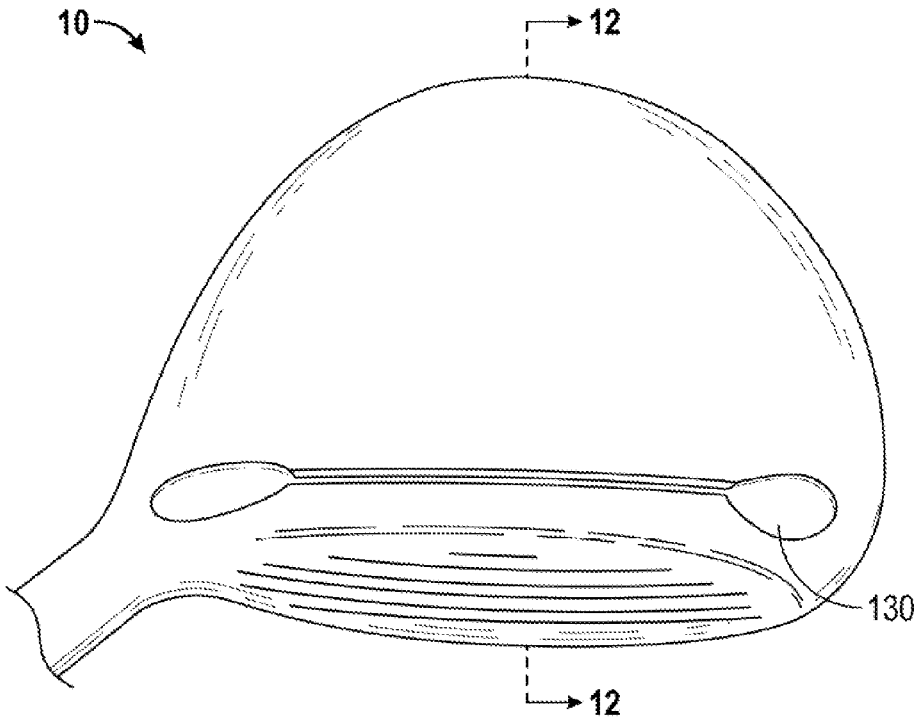
FIG. 11 is a sole, perspective view of a fourth embodiment of the present invention.
Figure 12:
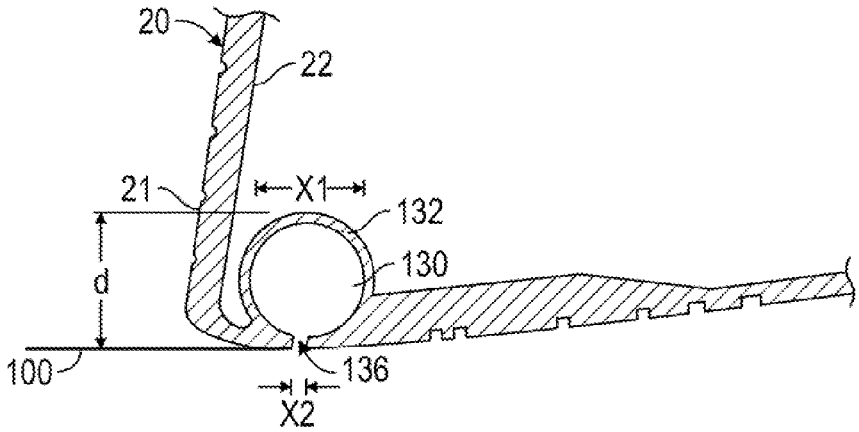
FIG. 12 is a cross-sectional view of the embodiment shown in FIG. 11 along lines 12-12.

Novel manufacturing techniques can be utilized to further optimize the surface opening of a groove, thus improving the interaction between the golf club and the turf. As shown in FIGS. 11-12, a fourth embodiment of the present invention includes a tube-shaped sole groove 130 with an opening 136 that has an even smaller width (x2) than those disclosed in FIGS. 7-10. This opening 136 preferably is integrally manufactured with the golf club head 10, but in an alternative embodiment the opening 136 can be cut into the tube-shaped groove 130 after the head 10 has been fabricated.

Figure 13:
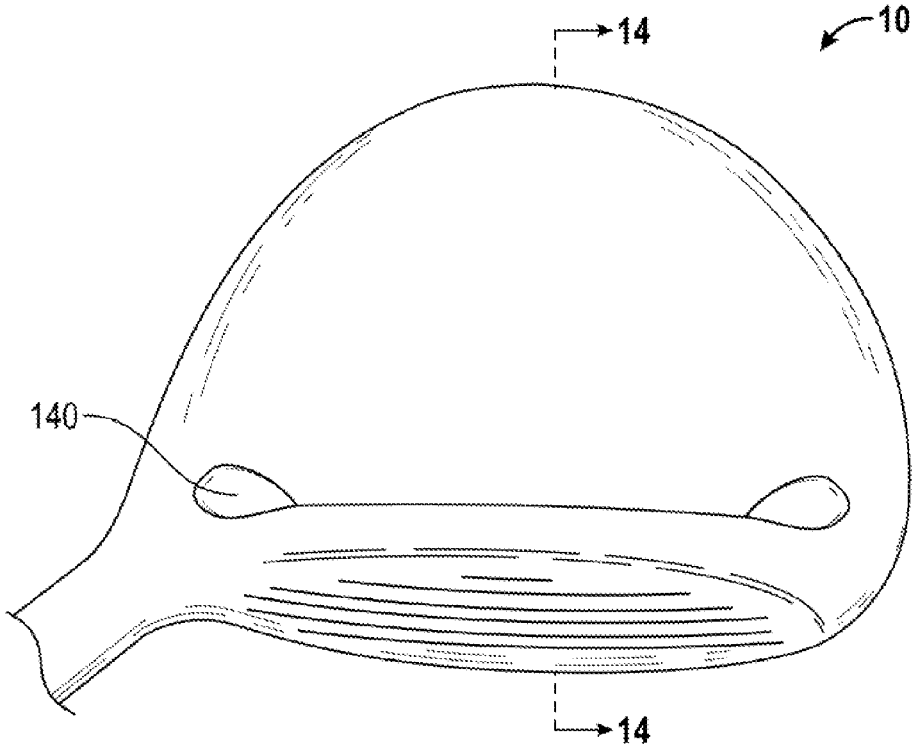
FIG. 13 is a sole, perspective view of a fifth embodiment of the present invention.
Figure 14:
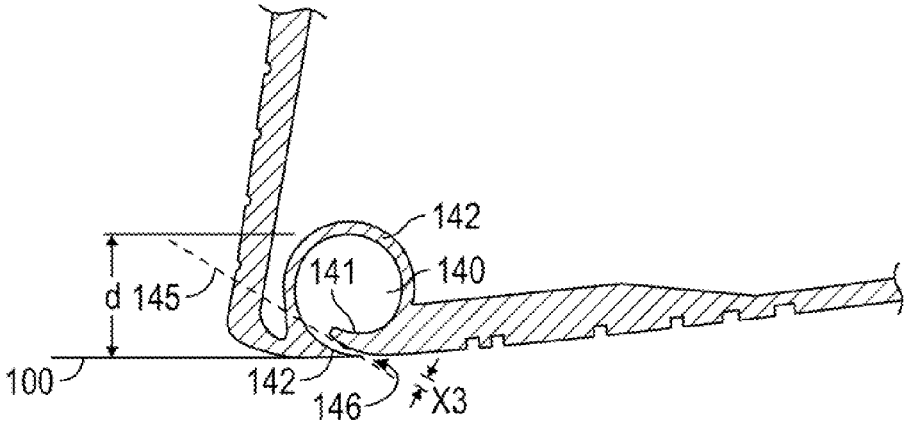
FIG. 14 is a cross-sectional view of the embodiment shown in FIG. 13 along lines 14-14.
Figure 21A:
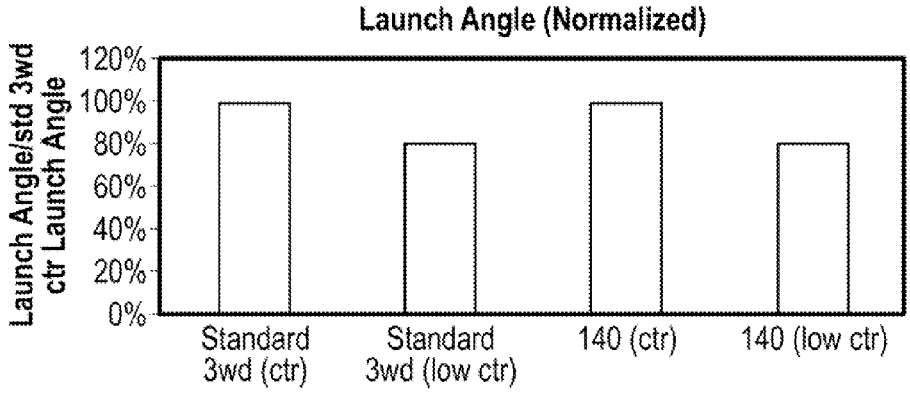
FIG. 21A is a graph comparing normalized launch angles of a standard fairway wood and a fairway wood comprising the fifth embodiment of the present invention.
Figure 21B:
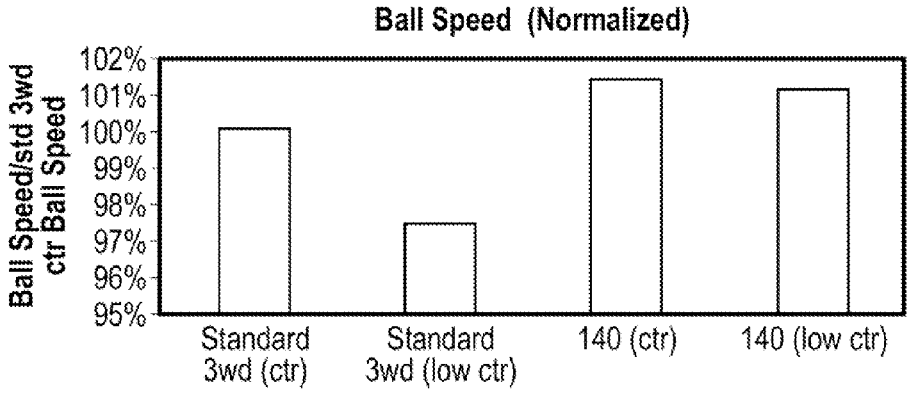
FIG. 21B is a graph comparing normalized ball speeds of a standard fairway wood and a fairway wood comprising the fifth embodiment of the present invention.
Figure 21C:
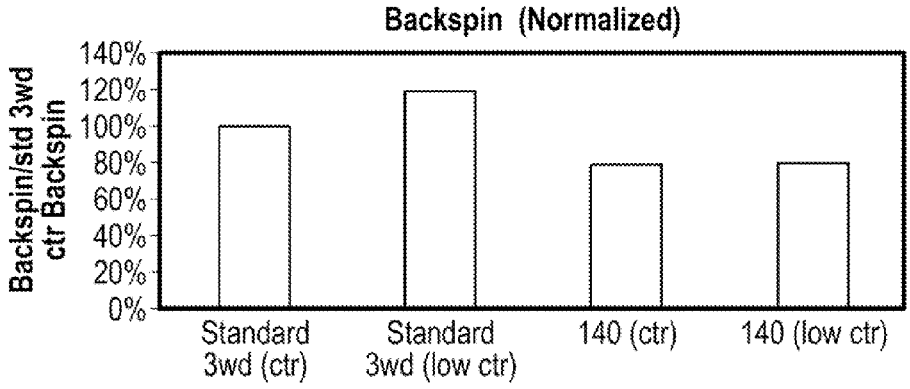
FIG. 21C is a graph comparing normalized backspin of a standard fairway wood and a fairway wood comprising the fifth embodiment of the present invention.

A fifth, preferred embodiment of the present invention, shown in FIGS. 13-14, includes a tube-shaped groove 140 with overlapping prongs 141, 142 that form an opening 146 having an axis 145 that is angled with respect to the ground plane 100 and a width (x3) that is the same as or smaller than the widths (x2) of the other sole grooves disclosed herein. The width (x3) of the opening 146 can be adjusted by moving the overlapping prongs 141, 142 of the groove 140 closer together or further apart. This groove 140 illustrates how features of the opening 146 can be adjusted without changing the overall shape of the groove 140, which in the fifth embodiment is practically identical to the tube-shaped groove 130 of the fourth embodiment. The tube shaped groove 140 shown in FIGS. 13-14 preferably is integrally formed via casting, but may be constructed from several pieces, as shown in FIGS. 16A and 16B and described herein. As shown in FIGS. 21A, 21B, and 21C, the tube-shaped groove 140 of the preferred embodiment, when incorporated into a 3-wood head, increases the ball speed of a golf ball struck at the center and low center of the golf club face, and decreases the backspin, without significantly affecting other important factors, including launch angle, that contribute to a golf ball's flight distance.

Sixth and seventh embodiments of the present invention are shown in FIGS. 15-20. These golf club heads include grooves 150, 160 with structures that are similar to the structure of the groove 140 of the preferred embodiment, in that they are tube-shaped and include openings 156, 166 with axes 155, 165 that are angled with respect to the ground plane 100, but these grooves 150, 160 are constructed from more than one piece of the golf club head 10 and thus can be formed using more traditional manufacturing processes. Specifically, the curved portion 152, 162 of these grooves 150, 160 can be formed by casting, forming, or machining the club head 10. The grooves 150, 160 are finished by affixing a sole plate or cover 200 to an exterior surface of the sole 15 to at least partially close the opening 156, 166 and alter its geometry. The sole 15 preferably has a recessed region 17 sized to receive the cover 200 so that it is flush with the surface of the sole and does not create any surface discontinuities.

Figure 15:
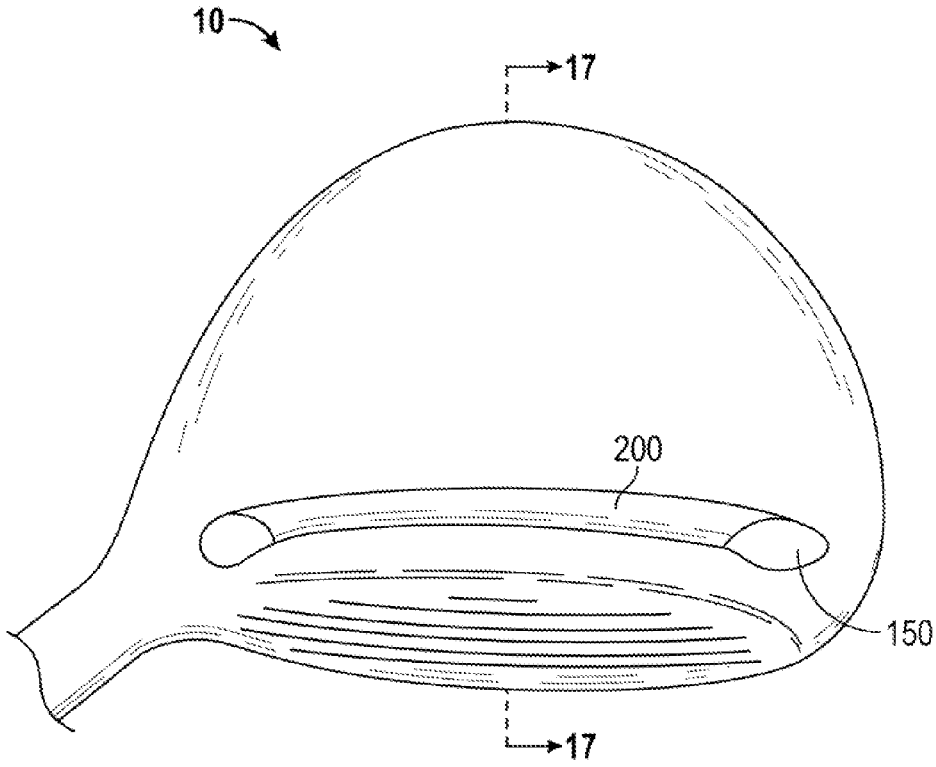
FIG. 15 is a sole, perspective view of a sixth embodiment of the present invention.
Figure 16:
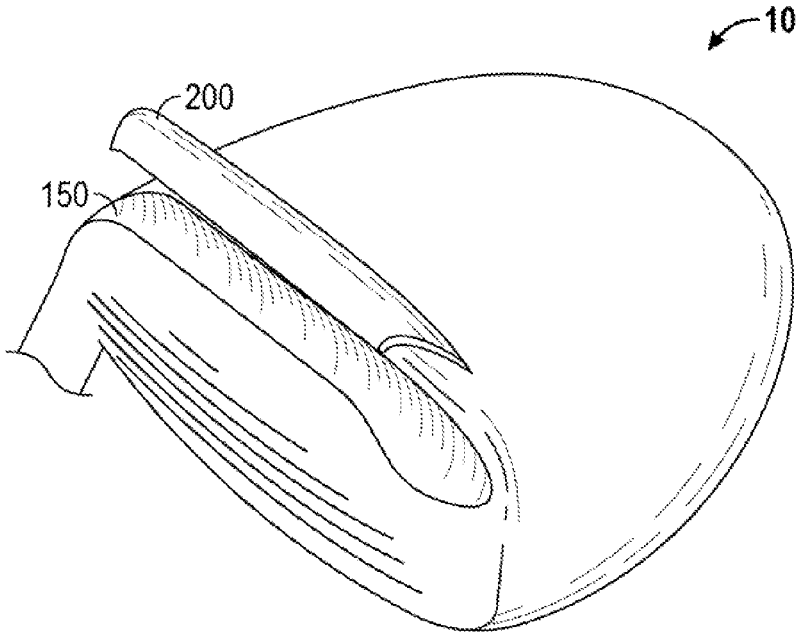
FIG. 16 is an exploded, perspective view of the embodiment shown in FIG. 15.
Figure 17:
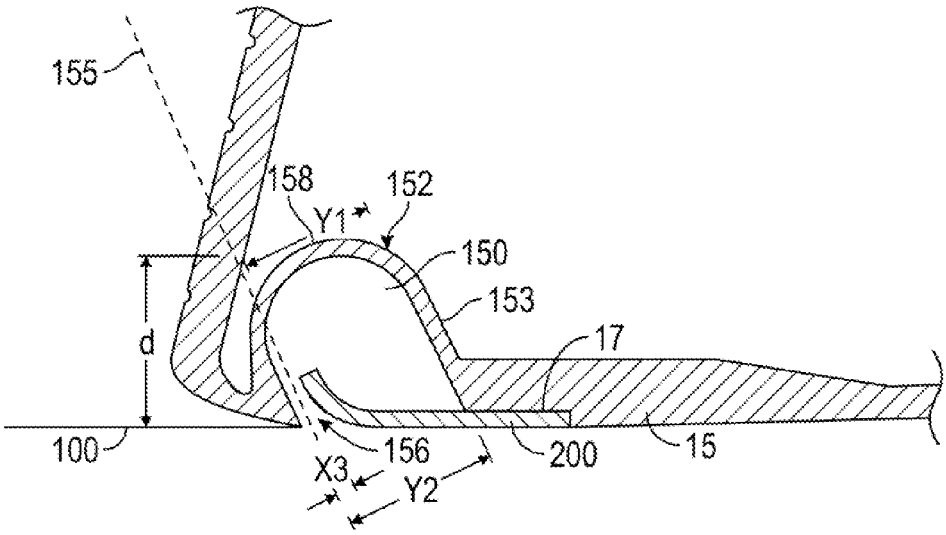
FIG. 17 is a cross-sectional view of the embodiment shown in FIG. 15 along lines 17-17.
Figure 18:
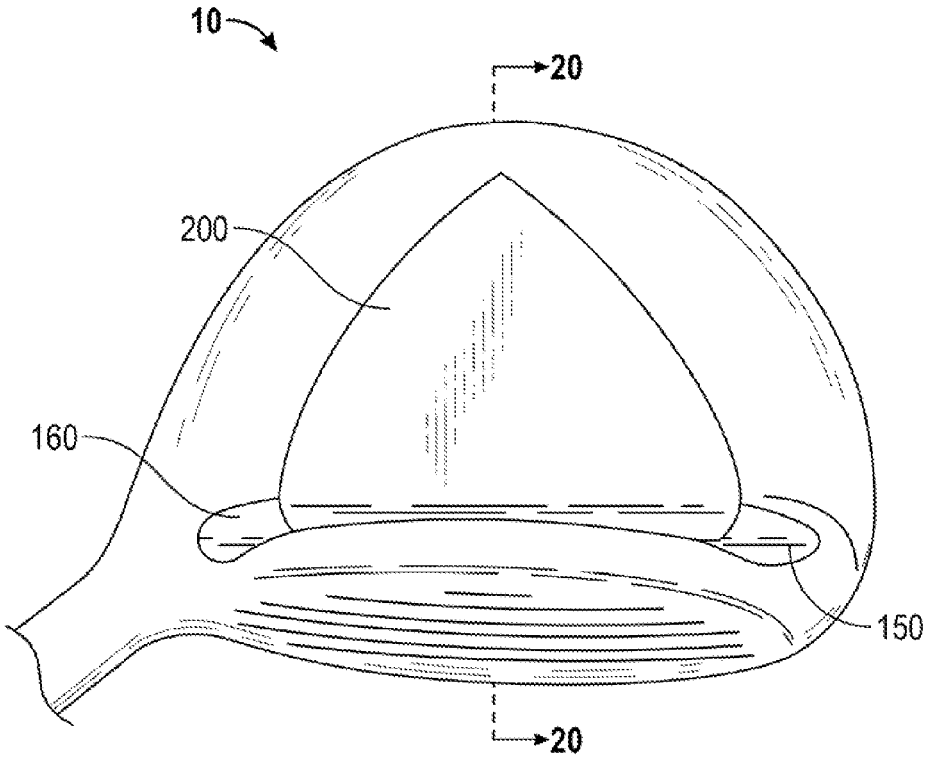
FIG. 18 is a sole, perspective view of a seventh embodiment of the present invention.
Figure 19:
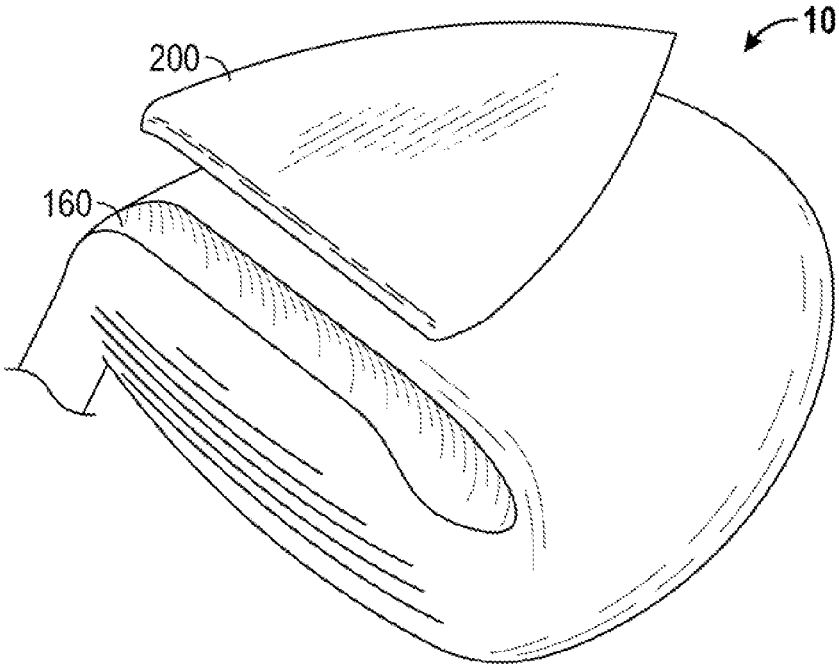
FIG. 19 is an exploded, perspective view of the embodiment shown in FIG. 18.
Figure 20:
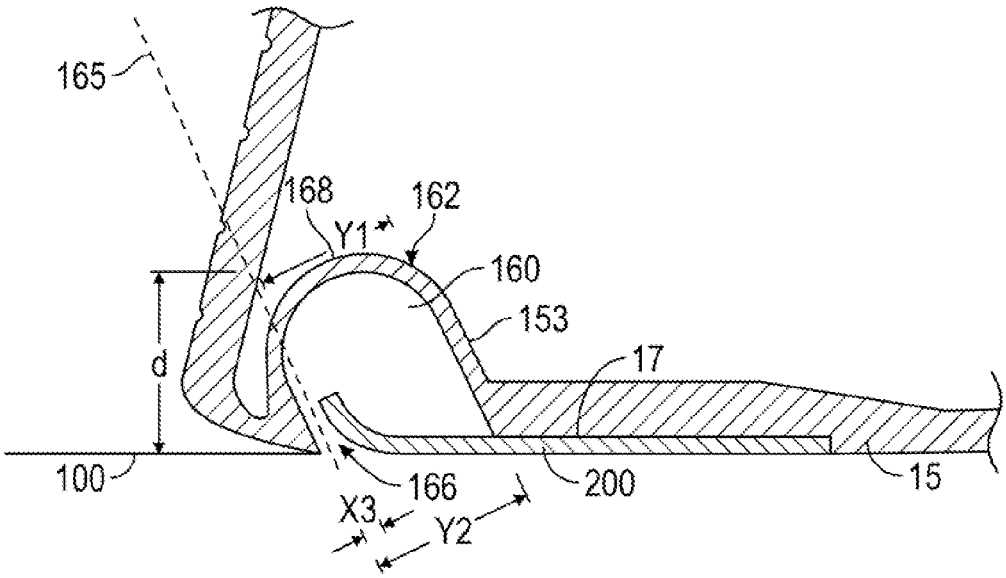
FIG. 20 is a cross-sectional view of a seventh embodiment of the present invention shown in FIG. 18 along lines 20-20.

The size, thickness, and material composition of the cover 200 preferably is selected by the manufacturer to affect the location of the club head's 10 center of gravity, the thickness of the sole 15, and the overall weight of the golf club head 10. The cover 200 may be small, as shown in FIGS. 15-17, to minimize added weight, or it may be large, as shown in FIGS. 18-20, to affect the characteristics of the golf club head 10 more significantly. The cover 200 may be affixed to the sole 15 by welding, bonding, brazing, mechanical fasteners, or a combination of these methods, which may be determined by the material used to create the cover 200. In some embodiments, the cover 200 is removably affixed to the sole 15 of the golf club head 10 to permit golfers to customize and adjust features of their golf club, including overall head weight and center of gravity location.

The grooves 150, 160 shown in FIGS. 15-20 represent a hybrid approach to face performance optimization because they have the novel, tube-shaped structure shown in FIGS. 11-14, and also include a feature of the prior art groove shown in FIG. 1. Specifically, the width (Y1) of these grooves' 150, 160 inward-most portion 158, 168 is approximately equivalent to the width (Y2) of the grooves' 150, 160 openings 156, 166 before they are altered by the cover 200. In alternative embodiments, the openings 156, 166 may have axes that are perpendicular to the ground plane 100 to further resemble the prior art grooves.

The embodiments shown in FIGS. 7-20 have grooves with configurations that completely decouple the groove opening size and shape from the actual groove size and shape, thus allowing both features to be optimized independently. For example, internal groove dimensions can be optimized for launch condition performance, while the groove opening can be optimized for turf interaction and increased aesthetic appeal. Specifically, the grooves 130, 140, 150, 160 of the fourth, fifth, sixth, and seventh embodiments of the invention have the following dimensions designed to optimize performance. The widths (x2, x3) of the openings 136, 146, 156, 166 are preferably between 0.010 and 1.00 inch, and more preferably between 0.030 and 0.075 inch, and most preferably approximately 0.040 inch. The openings 136, 146, 156, 166 preferably are located between 0.100 and 1 inch from the front surface 21 of the face 20, more preferably between 0.200 and 0.500 inch from the front surface 2, and most preferably approximately 0.330 inch from the front surface 21 of the face. The wall 132, 142, 53, 163 thicknesses of the grooves 130, 140, 150, 160 are preferably between 0.010 and 0.200 inch, more preferably between 0.020 and 0.075 inch, and most preferably approximately 0.030 inch.

The grooves 130, 140, 150, 160 preferably have diameters (x1,y1) of between 0.030 and 1 inch, more preferably between 0.100 and 0.500 inch, and most preferably of 0.310 inch, and a volume of between 0.100 and 1 cubic inch, more preferably between 0.200 and 0.500 cubic inch, and most preferably 0.145 cubic inch. The grooves 130, 140, 150, 160 preferably are located proximate an inner surface 22 of the golf club face 20, preferably between 0.005 and 1 inch, more preferably between 0.010 and 0.050 inch, and most preferably approximately 0.030 inch, and are preferably located between 0.010 and 1 inch from a front surface 21 of the face 20, more preferably between 0.100 and 0.500 inch from the from surface 21, and most preferably approximately 0.150 inch from the front surface 21. The grooves 130, 140, 150, 160 also preferably have a depth (d) from the innermost point of the groove 130, 140, 150, 160 to the ground plane 100 of between 0.010 inch and 1 inch, more preferably between 0.100 and 0.500 inch, and most preferably 0.410 inch. A golf club head incorporating one or more grooves 130, 140, 150, 160 of the present invention preferably has a sole 15 thickness of 0.030 to 0.50 inch, more preferably 0.040 to 0.100 inch, and most preferably 0.060 inch.

The sole grooves described herein can be used with any type of golf club head, but are preferably used with wood and hybrid-type clubs, and most preferably with fairway woods. Each of the grooves described herein may extend partially or completely across the golf club sole, and preferably extend in a toe-heel direction proximate the face. In alternative embodiments, the grooves described herein may be disposed on regions of the golf club head 10 other than the sole. For example, the grooves may extend along the heel and toe sides of the golf club head, or across the crown, as disclosed in U.S. Patent Application Publication Number 2011/0218053, the disclosure of which is hereby incorporated by reference in its entirety herein.

The golf club heads disclosed herein may have any volume, shape, or proportions and can be formed from one or more materials, including those material compositions disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

From the foregoing, it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:
a face component;
a sole comprising an elongated recess disposed proximate the face component; and
a cover,
wherein the recess is tube shaped and comprises an innermost surface and an opening, and
wherein the cover is affixed to the sole and partially covers the opening.

2. The golf club head of claim 1, wherein the recess extends from a heel side of the golf club head to a toe side of the golf club head.

3. The golf club head of claim 1, wherein the opening comprises an axis that is approximately perpendicular to a ground plane.

4. The golf club head of claim 1, wherein the opening comprises an axis that forms a non-ninety degree angle with a ground plane.

5. The golf club head of claim 1, wherein the recess further comprises two side walls, wherein the innermost surface is planar and is parallel with a ground plane, and wherein at least one of the side walls has an axis that forms a non-ninety degree angle with the ground plane.

6. The golf club head of claim 5, wherein both side walls have axes that form non-ninety degree angles with the ground plane.

7. The golf club head of claim 1, wherein the sole comprises a shallow recess sized to receive the cover such that the cover is flush with the sole when the cover is disposed within the shallow recess.

8. The golf club head of claim 1, wherein the cover is removably affixed to the sole.

9. The golf club head of claim 1, wherein the cover is composed of a high density material.

10. The golf club head of claim 1, wherein the golf club head is selected from the group consisting of a driver head, a fairway wood head, and a hybrid head.

11. The golf club head of claim 1, wherein the golf club head has a volume of no less than 50 cubic centimeters and no more than 300 cubic centimeters.

12. The golf club head of claim 1, wherein the face and the sole are integrally cast from a metal alloy.

13. The golf club head of claim 1, wherein a width of the opening is less than or equal to half of a width of the innermost surface.

14. The golf club head of claim 1, wherein a width of the opening is approximately equivalent to a width of the innermost surface.

15. The golf club head of claim 1, further comprising a junction between the face component and the sole, wherein the recess is disposed no more than 0.01 inch from the junction.

16. The golf club head of claim 1, wherein the recess has a volume of no less than 0.150 cubic inch and no more than 0.400 cubic inch.

17. The golf club head of claim 1, wherein the recess comprises a wall with a thickness of no less than 0.020 inch and no more than 0.075 inch.

18. A wood-type golf club head comprising:
a metal face component;
a metal sole comprising an elongated recess disposed proximate the face component; and
a cover,
wherein the sole comprises a shallow recess sized to receive the cover such that the cover is flush with an external surface of the sole when the cover is disposed within the shallow recess,
wherein the elongated recess extends from a heel side of the sole to a toe side of the sole,
wherein the elongated recess is tube shaped and comprises an innermost surface and an opening,
wherein a width of the opening is approximately equivalent to a width of the innermost surface, and
wherein the cover is affixed to the sole and partially covers the opening.

19. The wood-type golf club head of claim 18, wherein the cover is removably affixed to the sole.

20. The wood-type golf club head of claim 19, wherein the cover is composed of a high density material.

* * * * *